US008351300B2

(12) United States Patent
Sano

(10) Patent No.: US 8,351,300 B2
(45) Date of Patent: Jan. 8, 2013

(54) RADIO CONTROLLED TIMEPIECE

(75) Inventor: Takashi Sano, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 612 days.

(21) Appl. No.: 12/577,916

(22) Filed: Oct. 13, 2009

(65) Prior Publication Data

US 2010/0117910 A1 May 13, 2010

(30) Foreign Application Priority Data

Nov. 12, 2008 (JP) ..... 2008-289693

(51) Int. Cl.
*G04C 11/02* (2006.01)

(52) U.S. Cl. ..... 368/47

(58) Field of Classification Search ..... 368/10, 368/14, 46, 47, 278; 455/347, 550.1, 575.1, 455/575.7

See application file for complete search history.

(56) References Cited

U.S. PATENT DOCUMENTS

| | | | | |
|---|---|---|---|---|
| 7,333,063 | B2 * | 2/2008 | Yano et al. | 343/702 |
| 7,701,806 | B2 * | 4/2010 | Oguchi et al. | 368/47 |
| 7,813,712 | B2 | 10/2010 | Yasuoka et al. | |
| 2009/0316536 | A1 | 12/2009 | Kachi et al. | |

FOREIGN PATENT DOCUMENTS

| | | | |
|---|---|---|---|
| EP | 1 793 450 | A1 | 6/2007 |
| JP | 2004-325315 | A | 11/2004 |
| JP | 2005-257582 | A | 9/2005 |
| JP | 2007-263572 | A | 10/2007 |
| JP | 2008-232762 | A | 10/2008 |
| WO | WO 2008/007783 | A1 | 1/2008 |

OTHER PUBLICATIONS

Extended European Search Report dated Nov. 5, 2010 (in English) in counterpart European Application No. 09172423.7.

Japanese Office Action dated Aug. 10, 2010 and English translation thereof, issued in counterpart Japanese Application No. 2008-289693.

* cited by examiner

*Primary Examiner* — Edwin A. Leon

(74) *Attorney, Agent, or Firm* — Holtz, Holtz, Goodman & Chick, PC

(57) ABSTRACT

A radio controlled timepiece includes a housing and an antenna structure encased within the housing. The antenna structure includes a bar shaped core and a coil wound around the core, for receiving radio waves to set a current time. The housing includes a short hollow cylindrical metal case and a metal back cover engaged with one end of the case for closing. The housing further includes a housing fixing structure provided only on one of two parts of the housing divided by an axis of the bar shaped core.

7 Claims, 14 Drawing Sheets

RADIO CONTROLLED TIMEPIECE

CROSS-REFERENCE TO RELATED APPLICATION

This application is based upon and claims the benefit of priority from the prior Japanese Patent Application No. 2008-289693, filed on Nov. 12, 2008 the entire contents of which are incorporated herein by reference.

BACKGROUND OF THE INVENTION

1. Field of the Invention

The present invention relates to radio controlled timepieces and more particularly to their housing structures.

2. Description of the Background Art

Radio controlled timepieces are known which include an antenna structure which receives standard radio waves including time information to set a current time automatically based on the received radio waves. As the antenna structure, antennas are widely used which include a bar shaped core made of a magnetic material with high reception sensitivity such as an amorphous metal or ferrite, and a coil wound around the core.

With such timepiece, if there are metal members near the antenna structure, magnetic flux produced in the antenna structure due to received radio waves passes these metal members, thereby producing eddy currents, winch brings about an eddy current loss and reduces reception sensitivity.

Recently, the housing (or case and bottom cover) of the timepiece is made of a metal material such as titanium or stainless steel to produce an excellent design and a sense of high quality in addition to functionality. Even when the antenna structure is disposed within such a metal housing, it is required for such timepiece to have enough reception sensitivity.

SUMMARY OF THE INVENTION

An object of the present invention is to provide a radio controlled timepiece which has enough reception sensitivity even when the antenna structure is disposed within a metal housing. According to one aspect of the present invention, the radio controlled timepiece comprises: a housing and an antenna structure encased within the housing, the antenna structure including a bar shaped core and a coil wound around the core, for receiving radio waves to set a current time, the housing comprising a short hollow cylindrical metal case and a metal back cover engaged with one end of the case for closing purpose; and further comprising: a housing fixing structure for fixing the back cover to the case, the housing fixing structure being provided only on one of two parts of the housing divided by an axis of the bar shaped core.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which.

DESCRIPTION OF THE PREFERRED EMBODIMENT (First Embodiment)

Figure 1:
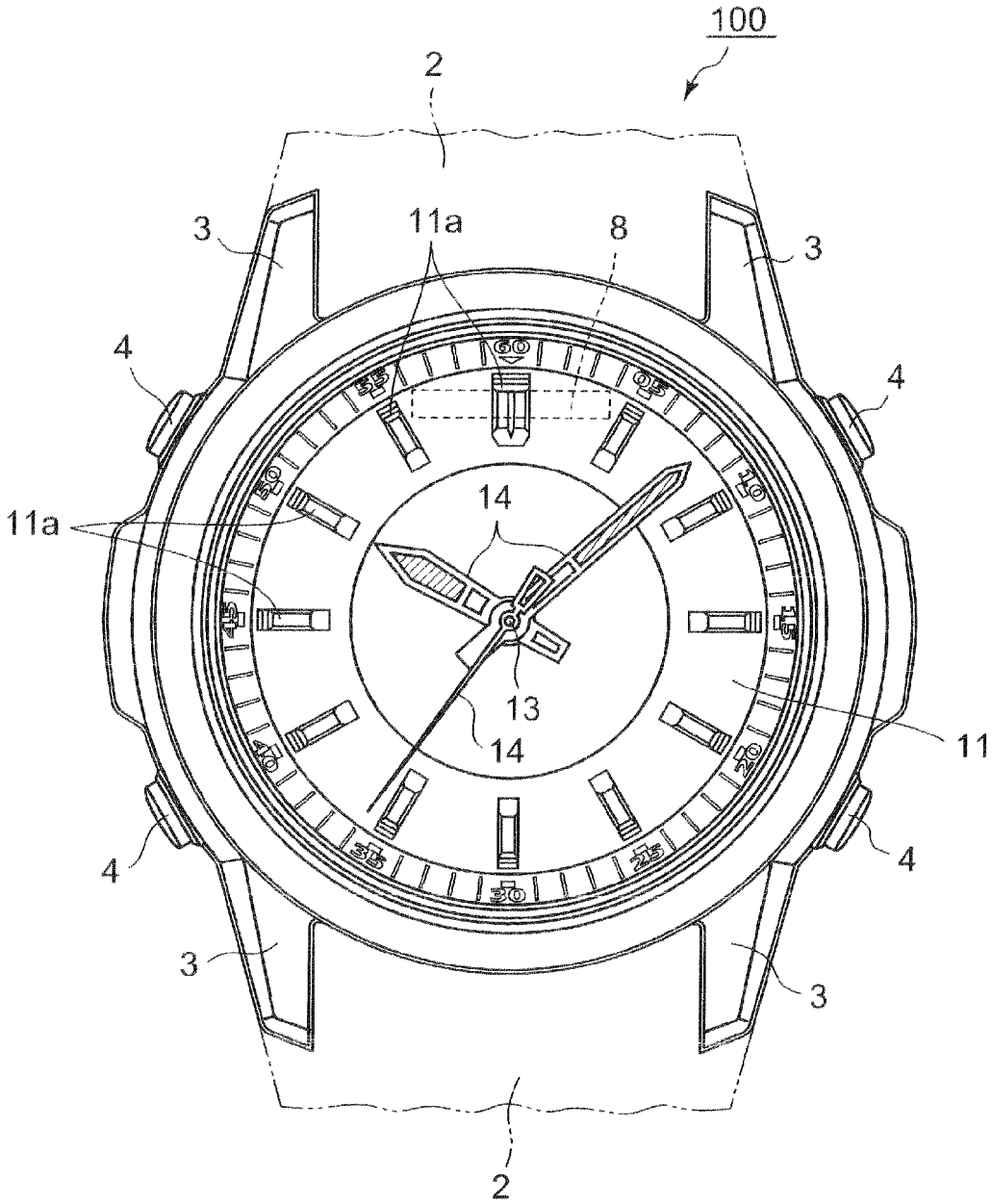
FIG. 1 is a front view of a first embodiment of a radio controlled timepiece according to the present invention.
Figure 2:
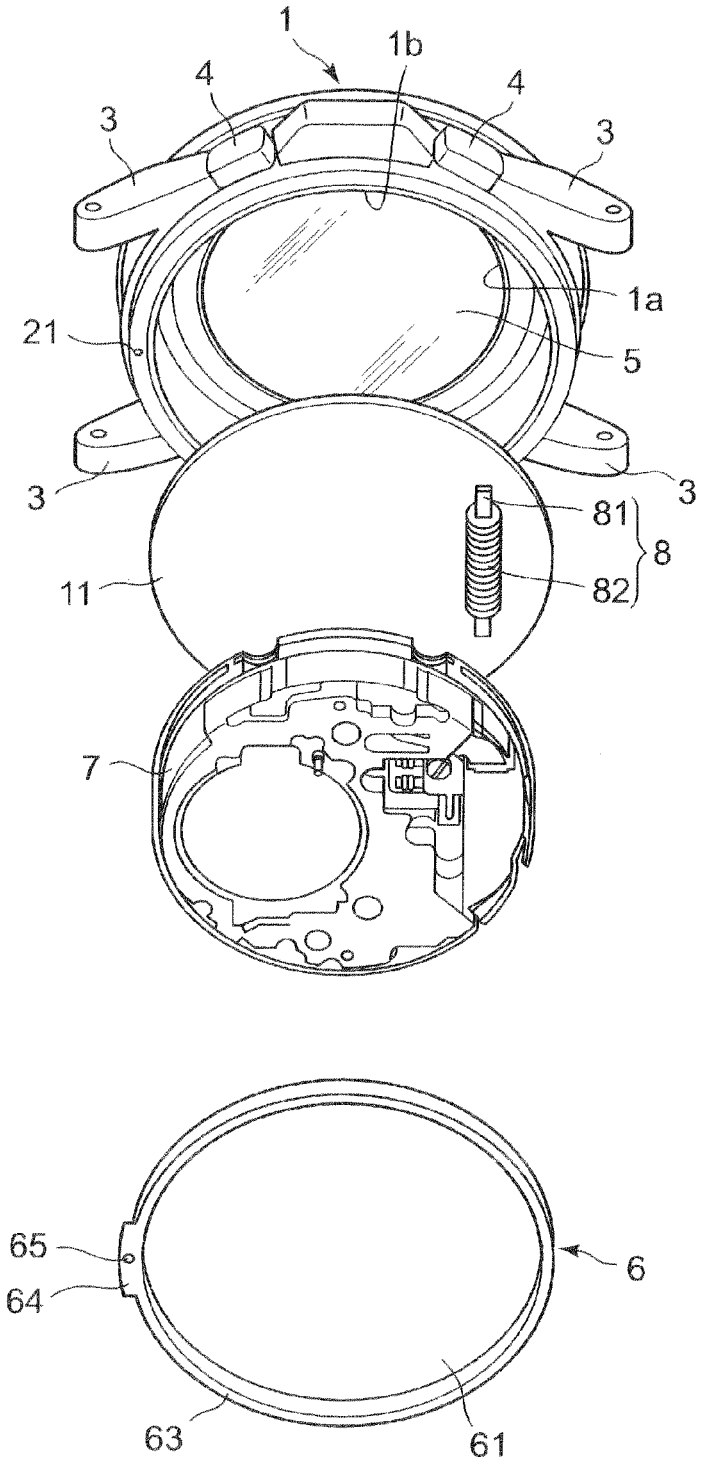
FIG. 2 is an exploded perspective view of the timepiece of FIG. 1.
Figure 3:
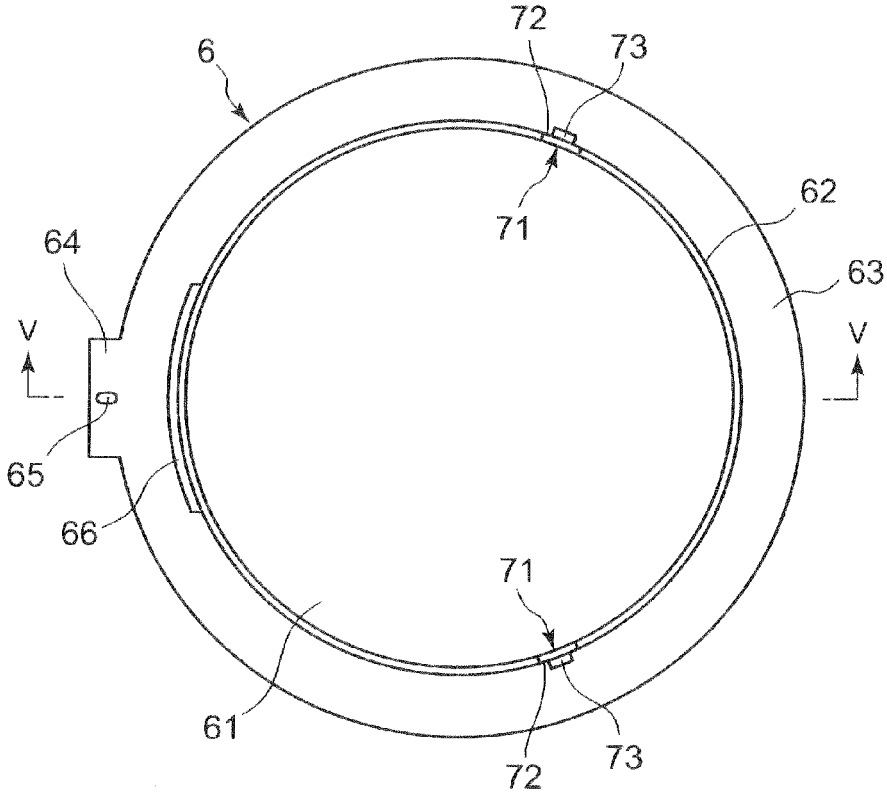
FIG. 3 is a plan view of a back cover of the timepiece of FIG. 1.

Referring to FIGS. 1-3, radio-controlled timepiece and more particularly wristwatch 100 as a first embodiment of the present invention will be described. FIG. 1 is a schematic front view of the wristwatch. FIG. 2 is an exploded view of the wristwatch.

As shown in FIG. 2, wristwatch 100 has hollow cylindrical ring-like case 1 made of an electrical-conductive material such as stainless steel or titanium.

Case 1 has wristband lug pairs 3 provided at the 6 and 12 o'clock positions on the wristwatch and to which wristbands 2 are attached at their ends. A plurality of operation buttons 4 are provided along the outer periphery of case 1 to issue several commands including, for example, one for time setting.

Non-conductive (for example, glass) cover 5, which is transparent to radio waves, is attached to upper end 1*a* of ring-like case 1 and back cover 6 is attached to the lower end 1*b* of case 1 through waterproof ring 16.

Provided within case 1 is inner housing 7 of a material or resin transparent to radio waves. Provided within inner housing 7 are various electronic parts such as a timepiece movement (not shown), a battery (not shown) which feeds power to associated elements of wristwatch 100, antenna structure 8 and a circuit board (not shown) on which, fur example, a reception circuit is provided.

Antenna structure 8 includes bar-shaped core 81 and coil 82 wound around core 81. When radio waves pass through core 81, an electric current is induced so as to flow through coil 82. Antenna structure 8 is disposed within housing 7 through a resilient adhesive. Coil 82 is connected at its ends to terminals (not shown) provided on the circuit board. The shape of antenna structure 8 is not limited to the example illustrated.

Core 81 is made of a material of high permeability μ or high specific permeability μs(=μ/μ0 where μ0 is the permeability of vacuum). The material of core 81 is not limited to ferrite and any other materials including an amorphous alloy may be used as long as an antenna core made of such material functions well. Core 81 is not limited to a single layer type one and may be a lamination, for example, of amorphous foils.

Dial 11 is placed below glass cover 5 (in FIG. 2) within case 1. As shown in FIG. 1, twelve different hour letters 11*a* are formed, respectively, at 1-12 o'clock positions on dial 11 along its periphery.

Hand stem 13 extends through a center hole (not shown) on dial 11 and has hour, minute and seconds hands 14 attached therein between glass cover 5 and dial 11. The timepiece movement turns hands 14 attached to stem 13 above dial 14.

Metal back cover 6 is attached through waterproof ring 16 (FIG. 6) to lower end 1*b* of case 1 with a slight gap between back cover 6 and the lower open end 1*b* of case 1, thereby securing electrical insulation between case 1 and back cover 6. In this embodiment, outer housing 10 (see FIG. 6) is composed of case 1 and back cover 6.

Figure 4:
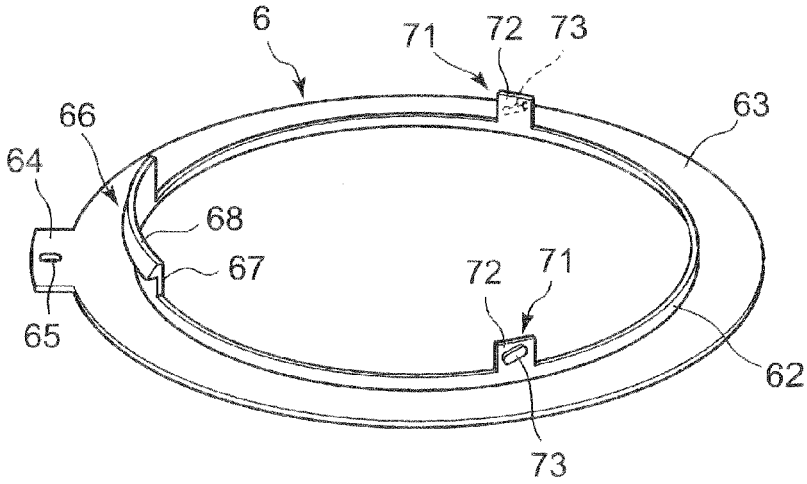
FIG. 4 is a perspective view of the back cover of FIG. 3.
Figure 5:
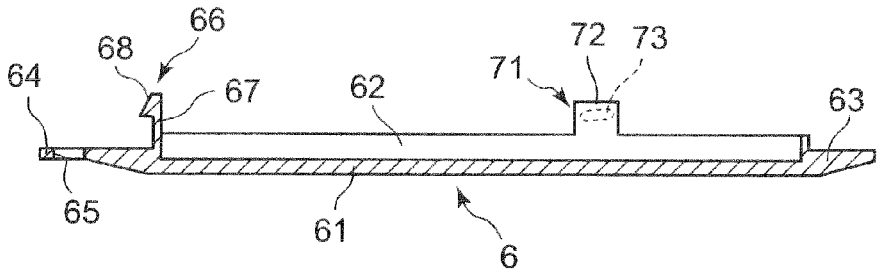
FIG. 5 is a cross-sectional view taken along a line V-V in FIG. 3.
Figure 6:
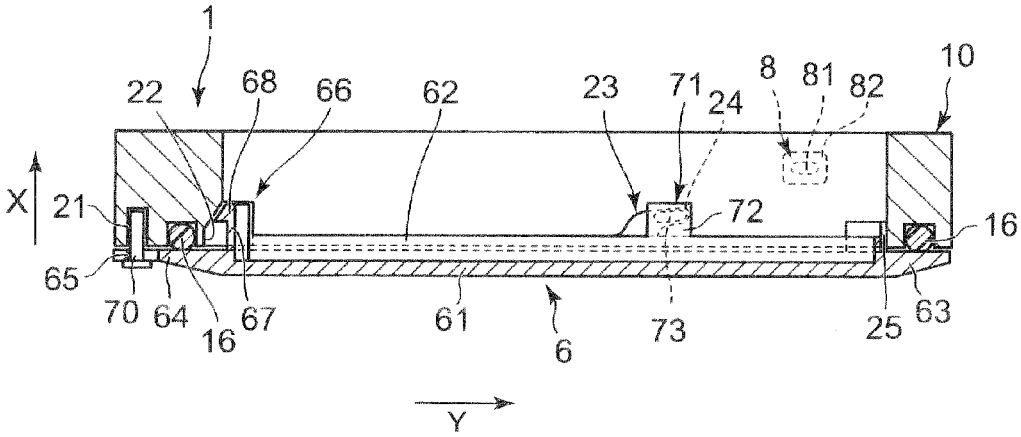
FIG. 6 is a cross-sectional view of an essential portion of the timepiece of the first embodiment in which the back cover is secured to the case.

Referring to FIGS. 3-8, a fixing structure for fixing case 1 and back cover 6 together will be described. FIG. 3 is a plan view of back cover 6 as viewed from the front side of wristwatch 100. FIG. 4 is a perspective view of back cover 6. FIG. 5 is a cross-sectional view taken along line V-V of FIG. 3. FIG. 6 is a cross-sectional view of the wristwatch where back cover 6 is mated with case 1. For convenience sake, inner housing 7 and glass cover 5, etc. received within case 1 are omitted for the brevity of illustration.

As shown in FIGS. 2 and 6, a face of lower end 1*b* of the side wall of case 1 has screw hole 21 thereon at the 6 o'clock position of the wristwatch to receive screw 70 to fix back cover 6 to case 1. Case 1 has engagement recess 22 on the inner surface of the lower end portion thereof near screw hole 21 to receive head 68 of upstanding engagement element 66 of back cover 6. Recess 22 has an inclined inner surface which increases outward downward or from the front side to the back side of the wristwatch.

Case 1 has two mating recesses 23 with elongated portion 24 provided on the inner surface thereof substantially at 2 and 10 o'clock positions on wristwatch 100. Each recess 23 receives a respective one of mating projections 71 provided at the 2 and 1.0 o'clock positions on the outer periphery of back cover 6, as shown in FIG. 8.

Insulating sheet 25, for example, of insulating resin, having substantially the same width as ring-like frame 62, is pasted on the inner periphery of a lower end portion of case 1 over the length of the inner periphery of the 12 o'clock side of two parts of case 1 divided by the axis of bar shaped core 81 intersecting with the inner periphery of case 1 to ensure electrical isolation between case 1 and ring-like frame 62 of back cover 6, thereby preventing occurrence of eddy currents securely.

The shape of insulating sheet 25 and its location are not limited to the illustrated ones as long as ring-like frame 62 of back cover 6 is insulated securely from case 1.

In this embodiment, back cover 6 includes bottom 61, ring-like frame 62 and flange 63 extending around the periphery of frame 62.

Flange 63 has lug 64 with radial slot 65 at the 6 o'clock position on the wristwatch through which slot screw 70 is inserted from the side of back cover 6 into case 1 to fix back cover 6 and case 1 together. In this embodiment, a screwing section is composed of lug 64 with slot 65 and screw hole 21 on case 1 through winch hole screw 70 is inserted and driven to fix back cover 6 to case 1.

Upstanding ring-like frame 62 of back cover 6 has arcuate engagement element 66 upstanding therefrom near lug 64 of back cover 6. As shown in FIG. 4, engagement element 66 includes support 67 upstanding from frame 62 and its outward overhanging head 68 with an outward downward inclined top surface.

When back cover 6 is mated with case 1, overhanging head 68 is engaged in engagement recess 22 provided on the inner surface of the lower end portion of case 1 (in FIGS. 5 and 6). That is, in this embodiment, back cover-side engagement element 66, case-side engagement recess 22, and the screwing section compose a screwing-fixing device to secure back cover 6 to case 1 with screw 70.

Figure 7:
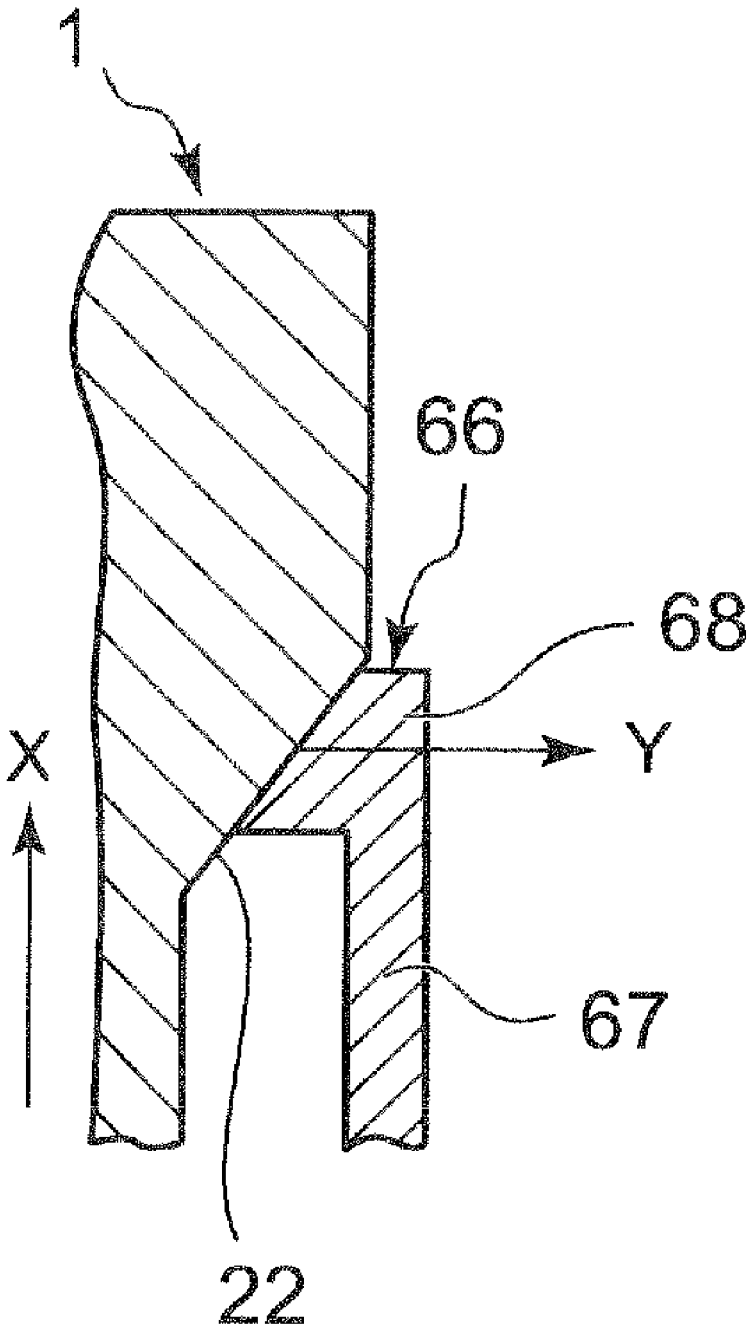
FIG. 7 is a cross-sectional view of an essential portion of the timepiece of the first embodiment, illustrating engagement of an engagement element provided on the back cover in an engagement recess provided on the case.

FIG. 7 is an enlarged view of an essential portion of the wristwatch, illustrating overhanging head 68 engaged in engagement recess 22. As shown in FIG. 7, when back cover 6 is mated with case 1, the inclined surface of head 68 of engagement element 66 is brought into contact slidably with the inclined surface of recess 22.

As shown in FIG. 6, as screw 70 is inserted from below into case 1 through holes 21 and 65 on case 1 and bottom cover lug 64, respectively, (in FIGS. 6 and 7) and then driven, back cover 6 is pushed in the X- and Y-directions because engagement element 66 slides on the inclined surface of overhanging head 68 along recess 22 on case 1.

Male mating units 71 are provided on upstanding frame 62 of back cover 6 at different positions corresponding to the positions on the inner periphery of case 1 where mating recesses 23 are formed. Each male mating unit 71 includes support 72 upstanding from ring-like frame 62 and projection 73 projecting radially outward from the outer peripheral surface of frame 62 and received in corresponding recess 23. In this embodiment, male mating unit 71 of back cover 6 and corresponding mating recess 23 formed on case 1 compose a matingly fixing device for matingly fixing back cover 6 and case 1 together.

Preferably, each mating projection 73 is coated with an insulating material to secure insulation between projection 73 and corresponding recess 24 and prevent occurrence of eddy currents securely. Although not limited, the method of coating projection 73 with the insulating material is achieved by forming a rigid film, for example, of DLC (Diamond-Like Carbon) film on the projection, for example, by chemical vapor deposition (CVD) such as thermal or plasma CVD, or physical vapor deposition (PVD) such as IP (Ion Plating) or sputtering.

Alternatively, an insulating film may be pasted on the projection. The insulating coating is not necessarily required to be applied on the whole projection 73, but may be applied only on the periphery of projection 73 which easily contacts recess 23 on case 1; for example, a lower periphery of projection 73. Alternatively, the insulating coating may be applied to recess 24 on case 1 or to both of projection 73 and recess 24.

Figure 8A:
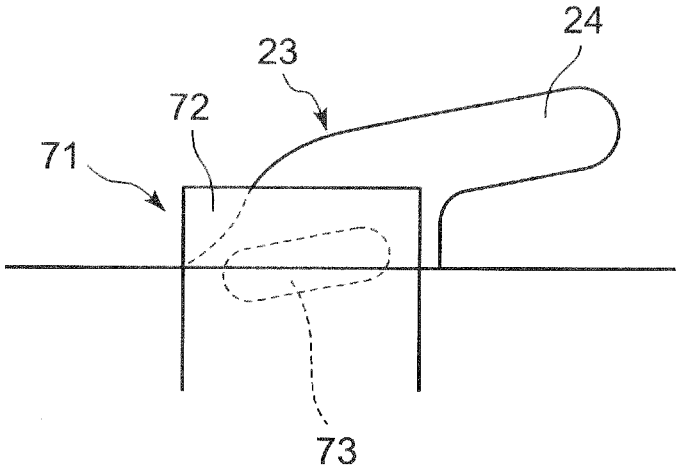
FIGS. 8A-8C illustrate sequential engaging stages where the case encounters until the case is completely engaged with the back cover.

FIGS. 8A, B and C show different sequential stages in which projections 73 of male mating unit 71 of back cover side are fitted into corresponding elongated recess portions 24 of recesses 23. As shown in FIG. 8A, when back cover 6 is engaged with case 1 in a state in which male mating units 71 of the back cover align with recesses 23, projections 73 are inserted into recesses 23.

Figure 8B:
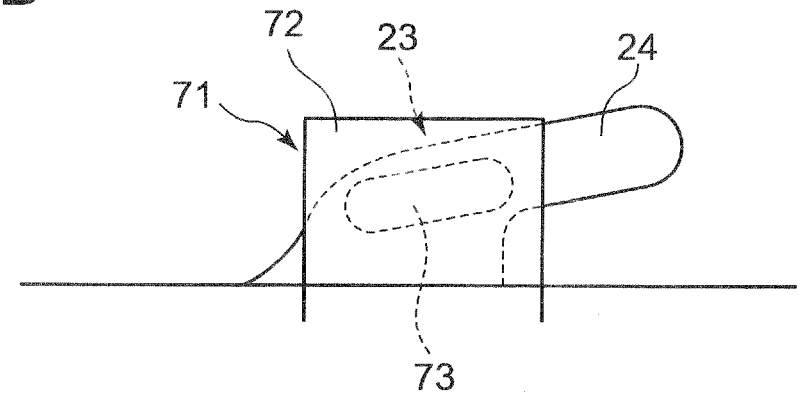
Figure 8C:
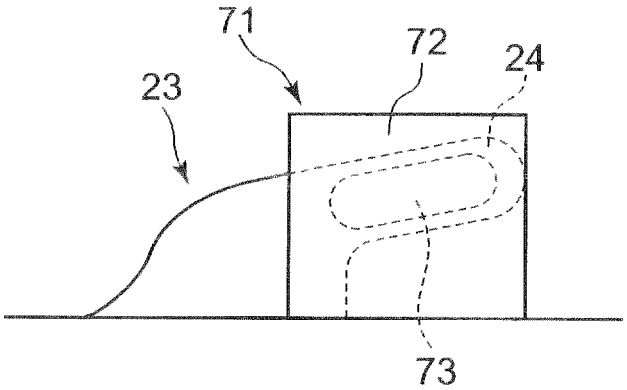

Then, when screw 70 is inserted into holes 65 and 21 in the bottom cover lug 64 and case 1 and then tightened, back cover 6 is pushed against case 1 and projections 73 are moved obliquely to the upper right along recesses 23, as shown in FIG. 8B. As screw 70 is further tightened, whole back cover 6 is slid in a Y-direction (in FIG. 6) as mentioned above, and then projections 73 are fitted finally into elongated recess portions 24, as shown in FIG. 8C.

Engagement element 66 and male mating units 71 of the back cover side have a slight resiliency. Thus, when back cover 6 is mated with case 1, they are temporarily bent inwardly, and then pushed against the inner surface of case 1 due to their own flexibility.

Figure 12:
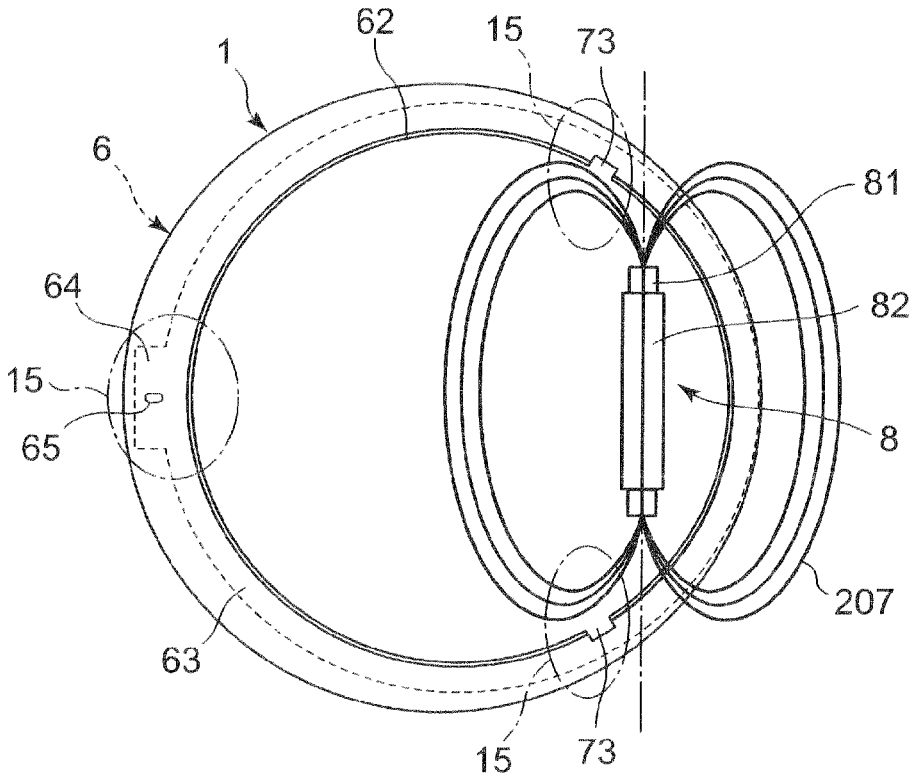
FIG. 12 is a view similar to that of FIG. 10, involving the timepiece of the embodiment.
Figure 13:
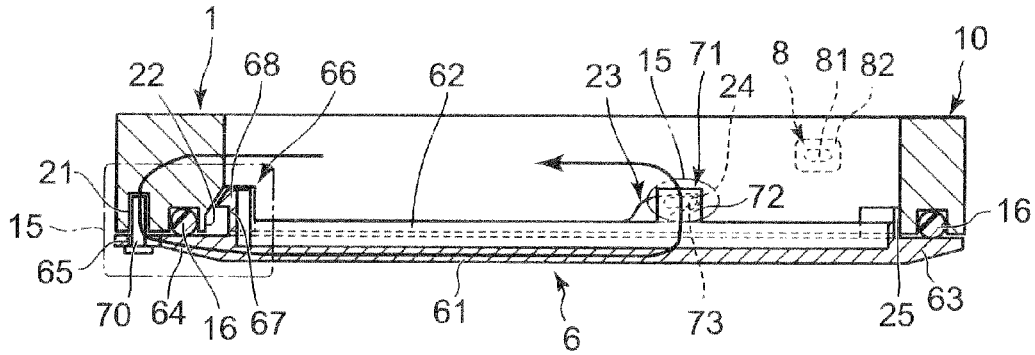
FIG. 13 is a view similar to that of FIG. 11, involving the timepiece of the embodiment.

As described above, in the present embodiment, there are three outer housing fixing structures 15 (FIGS. 12 and 13) which fix back cover 6 to case 1; i.e. one being the screwing section provided near the end of outer housing 10 most distant from antenna structure 8, and the other two being the matingly fixing devices provided at positions symmetrical about the 6 o'clock position on the wristwatch on the inner periphery of case 10 and nearer to the axis of bar shaped antenna core 81 than to the screwing section (FIGS. 12 and 13).

That is, back cover 6 and case 1 are fixed by the three outer-housing fixing structures 15 disposed only on one of the two parts of outer housing 10 divided by the axis of core 81 of antenna structure 8 received within outer housing 10 and no other fixing structures are provided on the other part of outer housing 10 (FIG. 12).

The fabricating method of wristwatch 100 of this embodiment will be described next. When wristwatch 100 is assembled, antenna structure 8, inner housing 7 and dial 11 are disposed in position within case 1 such that antenna structure 8 is near the 12 o'clock position on the wristwatch, and then back cover 6 is mated with case 1 through waterproof ring 16 from the back side of the wristwatch.

When back cover 6 is mated, two mating recesses 23 on case 1 are placed so as to align with respective corresponding male mating units 71 of back cover 6 and then back cover 6 is pushed against case 1 from the back side of the wristwatch such that ring-like frame 62 of back cover 6 fits into case 1. Further, hole 65 in lug 64 of back cover 6 is aligned with screw hole 21 in case 1, and then screw 70 is inserted from the back side of wristwatch 100 into holes 65 and 21.

Then, screw 70 is tightened. Thus, back cover 6 is pushed against case 1 (in the direction of the X-direction in FIG. 6), the head 68 of back cover-side engagement element 66 is slid along the inclined surface of recess 22 on case 1 and pushed out toward the 12 o'clock side of wristwatch 100 (in the Y-direction in FIG. 6). Thus, whole back cover 6 is slid in the Y-direction (FIG. 6).

When back cover 6 is pushed against case 1, waterproof ring 16 is compressed, thereby securing the waterproofness of outer housing 10. When whole back cover 6 is slid in the Y-direction while being pushed against case 1 (in the X-direction in FIG. 6), projections 73 of male mating units 6 are each moved upward along recess 23 on case 10 in the Y-direction, and then guided into elongated recess portion 24 (FIG. 8).

When screw 70 is completely tightened, projections 73 are fitted into respective elongated recess portions 24. That is, back cover 6 is fixed completely to case 1 by the tightening of screw 70 and the mating of the projections 73 into recess portions 24 on case 1.

Figure 9:
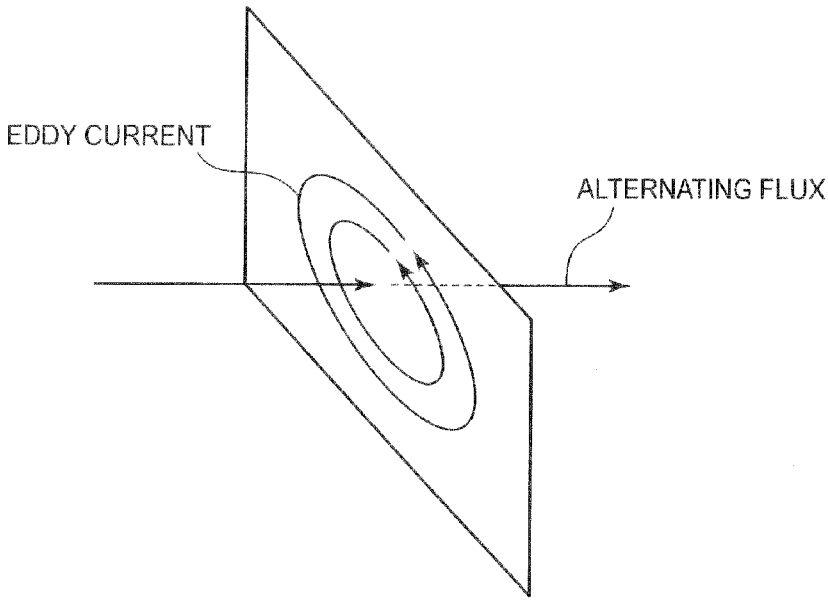
FIG. 9 illustrates a relationship between alternating flux and eddy current.

Now, a difference between the conventional method of fixing back cover 6 to case 1 and that used in the present embodiment will be described next. If some metal members are arranged near the antenna structure disposed within the metal case, alternating magnetic flux due to received radio waves stored in the antenna structure will pass through the case, thereby producing eddy currents in the metal members. As shown in FIG. 9, the eddy currents surround the alternating magnetic flux, which causes an eddy current loss and does not provide sufficient reception sensitivity.

Figure 10:
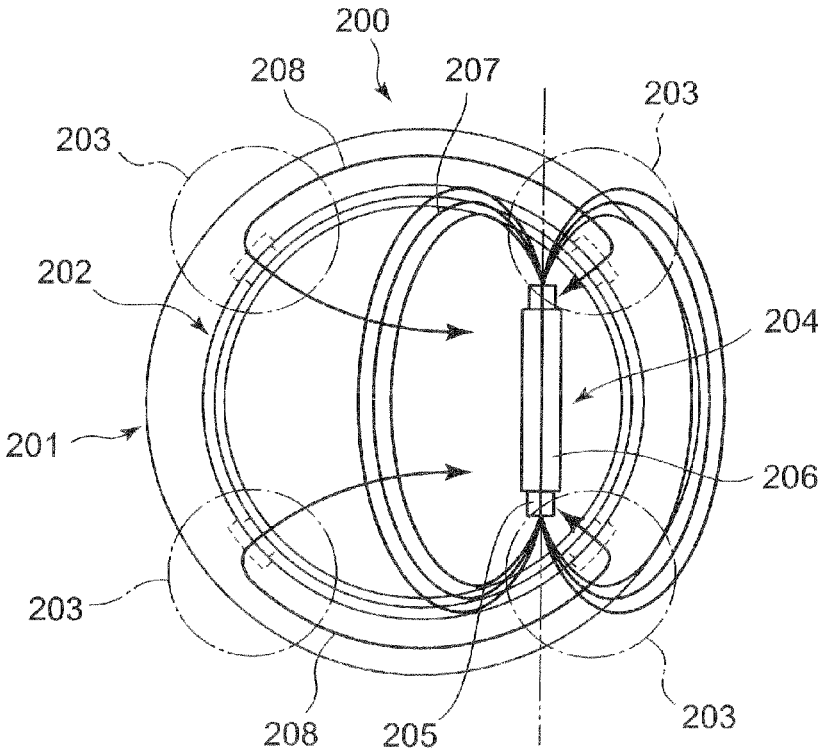
FIG. 10 (PRIOR ART)
FIG. 10 illustrates production of eddy currents in a radio controlled timepiece in which the case and the back cover are fixed together in a prior art method.

As shown in FIG. 10, generally, with conventional wristwatch 200, two outer-housing fixing structures 203 for fixing back cover 202 to case 201 (shown surrounded by a dot dashed line in FIG. 10) are disposed on one side of the axis of core 205 of antenna structure 204 (shown by a dot-dot dashed line in FIG. 10) and two more fixing structures 203 on the other side of the axis of core 205.

Figure 11:
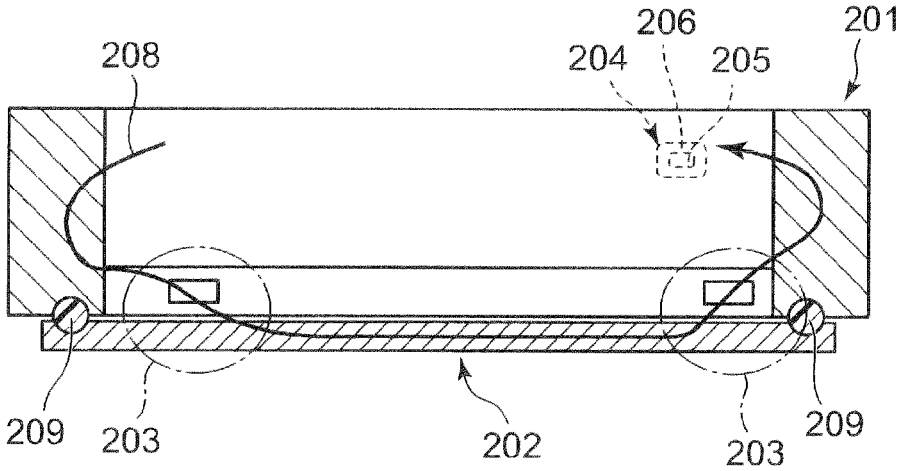
FIG. 11 (PRIOR ART)
FIG. 11 illustrates a flow of the eddy current occurring in the radio controlled timepiece of FIG. 10 shown in a cross-sectional view.

For example, as shown in FIG. 11, when back cover 202 is fixed to case 201 through waterproof ring 209, case 201 is not directly brought into surface contact with back cover 6. However, current paths are formed through four fixing structures 203. Thus, each, eddy current 208 is produced so as to surround a flow of alternating magnetic flux 207 stored in coil 206, thereby producing an eddy current loss.

In contrast, in this embodiment, as shown in FIGS. 12 and 13, all three outer-housing fixing structures 15 (shown by a dot-dashed line in FIGS. 12 and 13) are disposed only on one of two parts of outer housing 10 divided by the axis (shown by a dot-dot-dashed line in FIG. 12) of antenna core 81 disposed within outer housing 10. Back cover 6 is attached to case 1 through waterproof ring 16.

Thus, flange 63 of back cover 6 is not directly brought into contact with lower open end 1*b* of case 1. Thus, although case 1 and back cover 6 are made of metal, no paths of eddy currents 208 such as surround the flow of alternating magnetic flux 207 are formed, thereby preventing occurrence of an eddy current loss and keeping the reception sensitivity of antenna structure 8 high.

Since in this embodiment, one outer-housing fixing structure 15 is provided in the lug of outer housing 10 most distant from antenna structure 8 and the other two housing fixing structures 15 at other positions symmetrical about the 6 o'clock position of the wristwatch on the periphery of outer housing 10. Thus, back cover 6 is fixed to case 1 in a stabilized manner.

Since only a single screw is used to fix back cover 6 to case 1 at one position, the number of parts and the man hour for assembling are reduced and the cost and efficiency of production are improved compared to the conventional method of fixing the back cover to the case with four screws at corresponding different positions.

Figure 14:
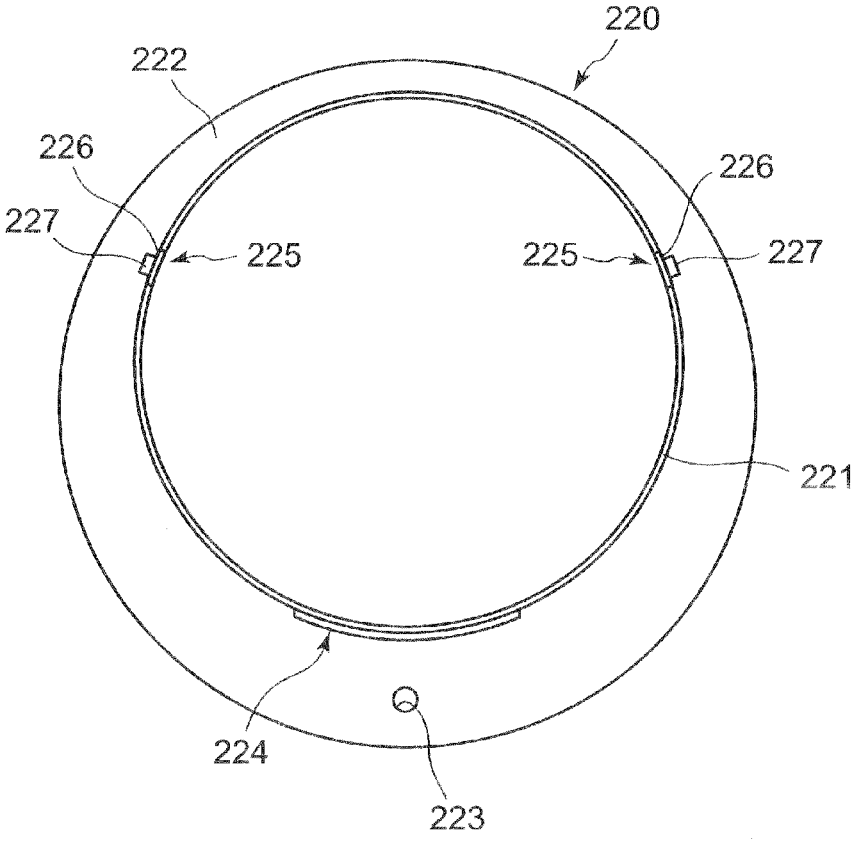
FIG. 14 is a plan view of a modification of the back cover of the first embodiment.

The shape of back cover 6 is not limited to the illustrated one. For example, as shown in FIG. 14, ring-like frame 221 may be placed eccentric to back cover 220 such that the center of a circle formed by ring-like frame 221 of back cover 220 is somewhat nearer to the 12 o'clock side of the wristwatch than to the center of whole back cover 220, thereby utilizing the area of back cover 220 outside frame 221 as flange 222.

Also, in this case, hole 223 is formed in a part of flange 222 most distant from antenna structure 8 (or near the 6 o'clock position of wristwatch on back cover 220). Back cover-side engagement element 224 is provided near hole 223 in the flange. Two back cover-side male mating units 225 are provided at positions symmetrical about the 6 o'clock positions on the outer periphery of ring-like frame 221 nearer to the axis of the bar shaped antenna core (not shown) than to hole 223.

As in the first embodiment, also in this case, each back cover-side engagement unit 224 includes an upstanding support (not shown) with an engagement head (not shown). Each male mating unit 225 includes upstanding support 220 with outward mating projection 227.

Figure 15:
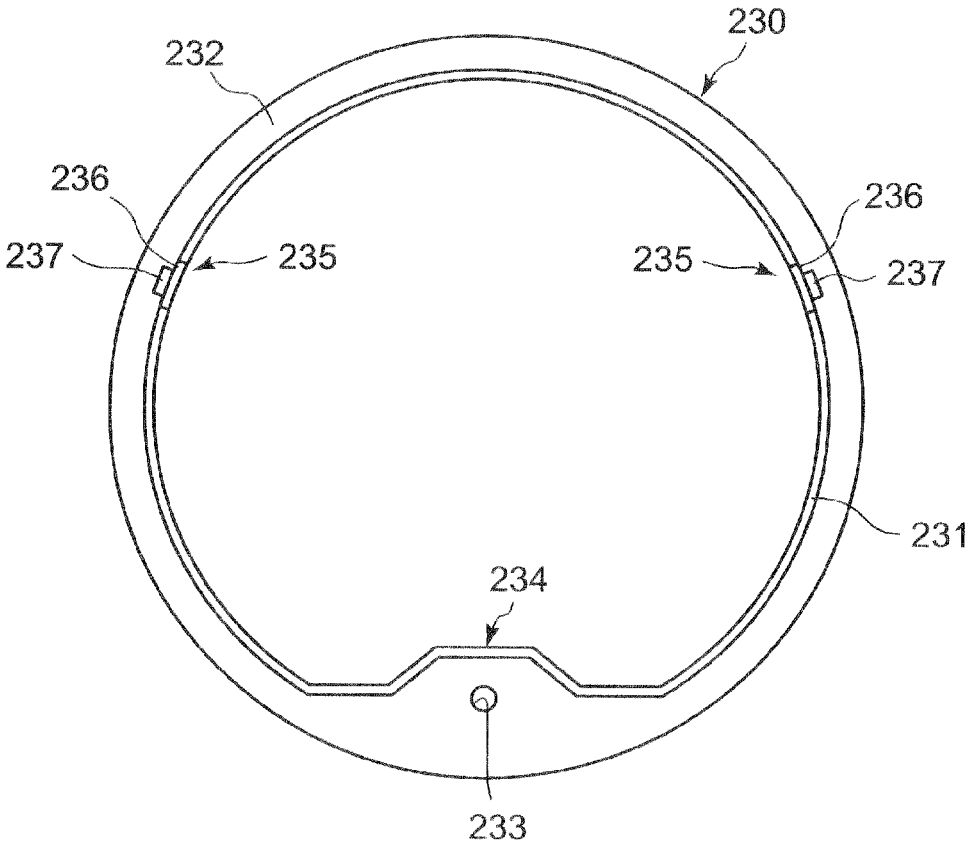
FIG. 15 is a plan view of an essential portion of another modification of the back cover of the first embodiment.

Alternatively, as shown in FIG. 15, a part of frame 231 on the 6 o'clock side of the wristwatch may be dented toward the center of back cover 230 such that flange 232 around frame 231 have a wider flange portion with hole 233 before the dented frame portion. Also in this case, back cover-side engagement element 234 is provided near hole 233 on the wider flange portion.

Further, two back cover-side male mating units 235 are provided at positions symmetrical about the 6 o'clock position near hole 233 on the outer periphery of ring-like frame 231 and nearer to the axis of the antenna core (not shown) than to hole 233 or the screwing section. As in the first embodiment, also in this case, back cover-side engagement element 234 comprises an upstanding support (not shown) with an engagement head (not shown), and each back cover-side male mating unit 235 comprises upstanding support 236 with mating projection 237.

(Second Embodiment)

Figure 16:
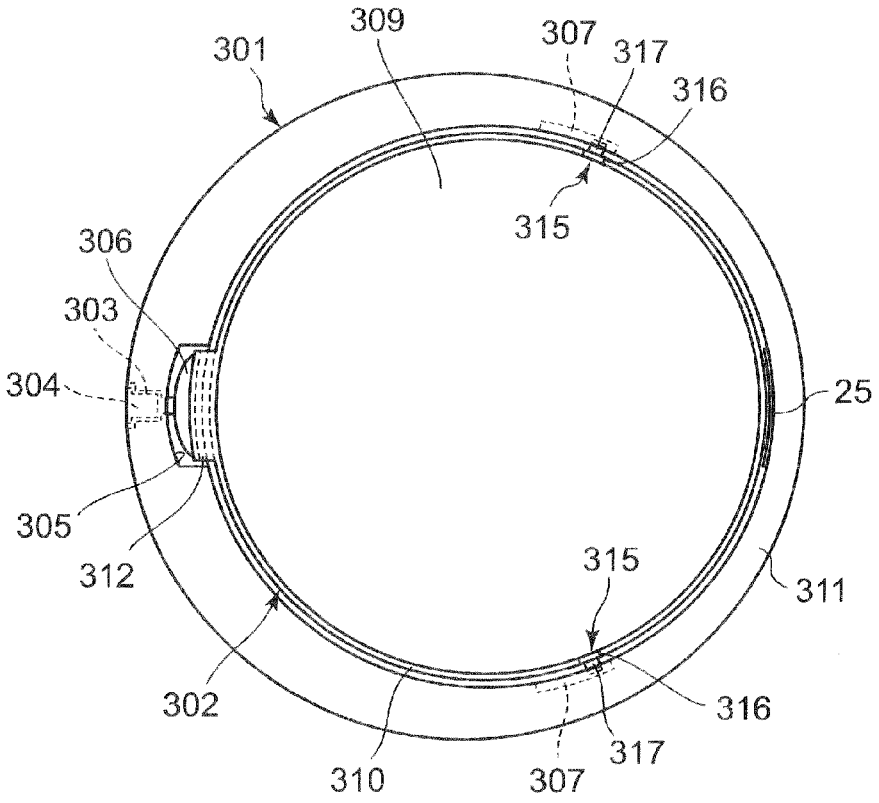
FIG. 16 is a plan view of a second embodiment of the timepiece in winch the back cover is secured to the case.
Figure 17:
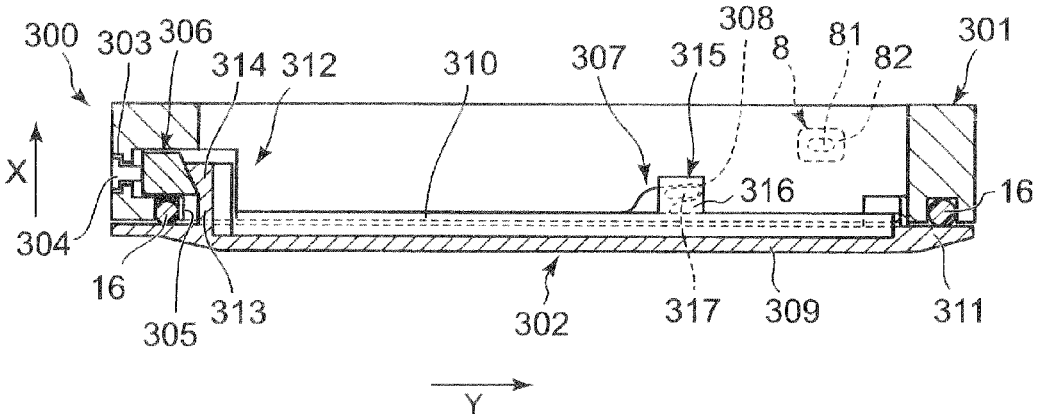
FIG. 17 is a cross-sectional view of the essential portion of the second embodiment where the back cover is secured to the case.
Figure 18:
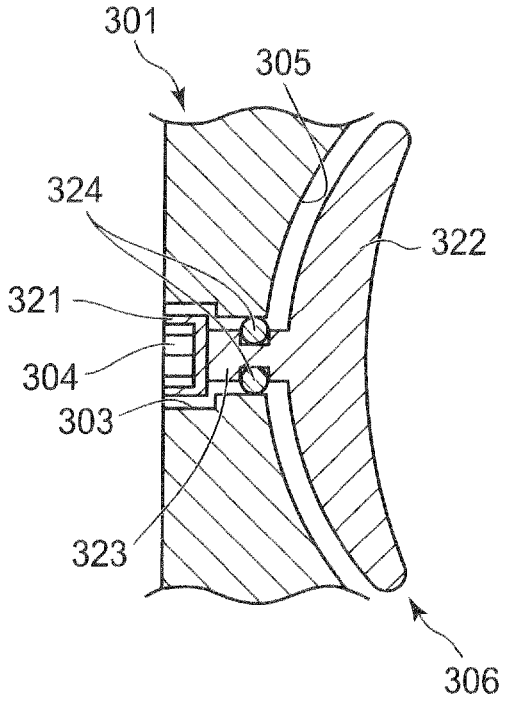
FIG. 18 is a cross-sectional view of a screwing-fixing device in the second embodiment.

Referring to FIGS. 16-18, a second, embodiment of the radio controlled wristwatch according to the present invention will be described. The second embodiment is different from the first embodiment with reference to the structure in which the back cover is mated with the case. Thus, in this embodiment, the difference in the structure will be described especially.

In the second embodiment, the radio controlled wristwatch has outer housing 300 composed of case 301 and back cover 302 as in the first embodiment. As shown in FIGS. 16 and 17, the side wall of case 301 has engagement recess 305 on its inner lower surface portion which receives engagement element 314 of back cover 302 at the 6 o'clock position on the wristwatch.

The side wall of case 301 has screw hole 303 at the 6 o'clock position on the wristwatch through which screw 304 is inserted so as to extend horizontally from the 6 o'clock side to engagement recess 305 on the side wall of case 301 to fix back cover 302 lo case 301. Non-conductive member 321 (FIG. 18), for example, of a non-conductive resin is provided in screw hole Push member 306 which pushes engagement element 312 of back cover 302 into case 301 is disposed within recess 305. FIG. 18 is a cross-sectional view of push member 306 and its peripheral structure. Push member 306 includes push head 322 which pushes, on its surface inclined to the lower right (FIG. 17), engagement element 314 upstanding from back cover 302, and leg 323 which extends from push head 322 through screw hole 303 on case 301 and transmits a push force from screw 304 inserted in hole 303 to push head 322.

Leg 323 has O-ring 325 thereon to prevent leak of water from screw hole 303 into outer housing 300. When screw 304 is inserted into hole screw and driven, screw 304 pushes leg 323 of push member 306 through the non-conductive member 321 into case 301.

Case 301 has, on its inner periphery, two mating recesses 307 near the 2 and 10 o'clock positions on wristwatch 100 to receive corresponding bottom cover-side male mating units 315 provided near the two mating recesses 307 of case 301 on the outer periphery of bottom cover 302. Each mating recess 307 has elongated recess portion 308 which receives a respective one of mating projections 317 of male mating units 315.

Like the first embodiment, insulating sheet 25, for example, of insulating resin, is pasted on the lower inner end portion of case 301 over the length of the inner periphery of the 12 o'clock side one of two parts of case 301 divided by the axis of bar shaped core 81 disposed within outer housing 300 and intersecting with the inner periphery of case 301 to ensure electrical isolation between case 301 and back cover 302. It is noted that prior art insulating processes other than pasting insulation sheet 25 may be used as in the first embodiment.

In this embodiment, back cover 302 includes bottom 309, ring-like hollow cylindrical frame 310 extending around the periphery of bottom 309 and flange 311 extending around the periphery of frame 310.

Ring-like frame 310 has back cover-side engagement element 312 at the 6 o'clock position of the wristwatch on back cover 302. Engagement element 312 has upstanding support 313 and engagement head 314 overhanging outward from a top of upstanding support 313. Engagement head 314 is adapted to engage in engagement recess 305 on case 301 when back cover 302 is mated with case 301. Engagement head 314 has a surface inclined downwardly inwardly of case 301 in FIG. 17 corresponding to the inclined surface of engagement recess 305.

Frame 310 has two back cover-side male mating units 315 provided on the outer periphery thereof adjacent to respective recesses 307 on the inner periphery of case 301. Each male mating element 315 has upstanding support 316 and mating projection 317, which fits finally into elongated recess portion 308 of recess 307, provided on the outer surface of upstanding support 316.

In this embodiment, a screwing-fixing device includes screw hole 303 on case 301, engagement recess 305, push member 306, and back cover-side engagement element 312. Each back cover-side male mating element 315 and corresponding mating recess 307 compose a respective matingly fixing device. The screwing-fixing device and the two matingly fixing devices compose an outer-housing fixing structure which fixes back cover 302 to case 301.

As described above, in the present embodiment, case 301 is fixed to back cover 302 at the three points; i.e. one being the screwing-fixing device provided near the end of outer housing 300 most distant from antenna structure 8, and other two being matingly fixing devices provided at positions nearer to the axis of antenna core 81 than to the screwing section and symmetrical about the 6 o'clock position of the wristwatch on the inner periphery of case 301 on one of two parts of outer housing 300 divided by the axis of bar shaped antenna core 81. No other fixing structures are provided on the other of the two of outer housing 300 divided by the axis of the core 81.

The other parts of the second embodiment similar to those of the first embodiment are identified by the same reference numerals and letters, and further description thereof will be omitted.

Now, the fabricating method of this embodiment will be described next. When back cover 302 is mated with case 301, two recesses 307 on case 301 are placed, so as to align with respective male mating units 315 of back cover 302 and then back cover 307 is pushed against case 301 such that upstanding ring-like frame 310 of back cover 307 is fitted into case 301.

Further, screw 304 is inserted from outside into horizontal screw hole 304 on case 301 and then driven from the 6 to 12 o'clock direction of the wristwatch. Thus, push member 306 is pushed into case 301 by screw 304, thereby causing the inclined surface of push head 322 to slidably contact the inclined surface of head 314 of engagement element 312.

Further, by tightening screw 304, back cover-side engagement element 312 is pushed upward along the inclined surface of push member 306 tin the X-direction of FIG. 17) and back cover 302 is pushed against case 301. Simultaneously, head 314 of engagement element 312 is slid upward on the inclined surface of head 322 of push member 306 while being pushed out toward the 12 o'clock position on the wristwatch (or in the Y-direction in FIG. 17).

Thus, whole back cover 302 is slid in the Y-direction in FIG. 17 while being pressed against case 301 in the X-direction of FIG. 17. In this case, projections 317 of back cover-side male mating units 315 move upward in the Y-direction along recesses 307 into corresponding elongated recess portions 308. When screw 304 is completely tightened, projections 317 are fitted into respective elongated recess portions 308. That is, back cover 302 is fixed to case 301 by the tightening of screw 304 and the fitting of projections 317 into elongated recess portions 308 on case 301.

As described above, according to this embodiment, the outer-housing fixing structure for fixing case 301 and back cover 302 together is disposed only on one of the two parts of the outer housing divided by the axis of antenna core 81 disposed within outer housing 300. Thus, no paths of eddy currents such as surround a flow of alternating magnetic flux are formed, thereby preventing occurrence of an eddy current loss and keeping the reception sensitivity of antenna structure 8 high although case 301 and back cover 302 are made of metal.

Back cover 302 is fixed to case 301 in a stabilized manner because they are fixed at three appropriate points: i.e., one being near the part of outer housing 300 most distant from antenna structure 8 and the other two being at different positions nearer to the axis of the antenna core than to that part, of the outer housing on the periphery of outer housing 300.

Since back cover 302 is screwed to case 301 on the side of outer housing 300, no screws appear when the wristwatch is viewed from its back side, thereby providing a clear appearance. Since one screw is used only at a single position for fixing purpose, the number of parts and the man hour for assembling are reduced, thereby improving production cost and efficiency.

Figure 19:
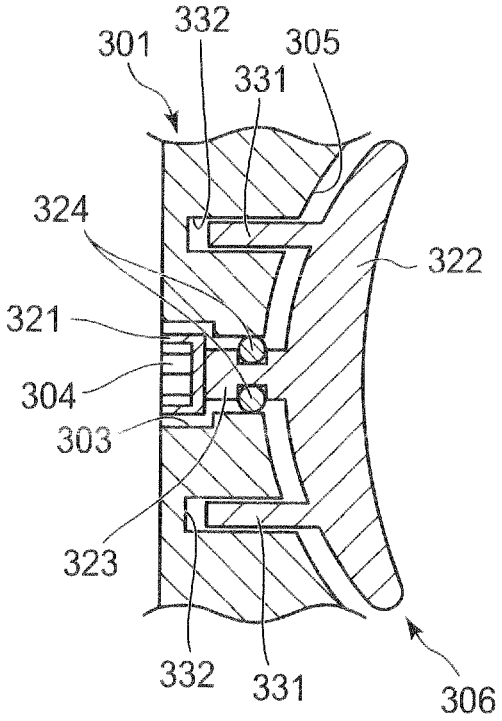
FIG. 19 is a cross-sectional view of a modification of the screwing-fixing device in the second embodiment.

The structure of push member 306 is not limited to the particular one illustrated, herein. For example, as shown in FIG. 19, arrangement may be such that, in addition to central leg 323, push member 306 has two auxiliary legs 331, one on each side of the central leg, and that case 308 has two holes 332 which receive respective auxiliary legs 331. Provision of auxiliary legs 331 serves to prevent push member 322 from becoming loose. Thus, head 314 of back cover 302 can be pushed in a more stabilized manner than when only leg 323 is used for pushing purpose.

While in the embodiment, screw 304 is illustrated as being inserted from left substantially perpendicular to the extending direction of push head 322 into screw hole 303 provided on case 301 extending in the 6-12 o'clock direction, the angle of the screw 304 insertion to the extending direction of push head 322 is not limited to this particular case.

Figure 20:
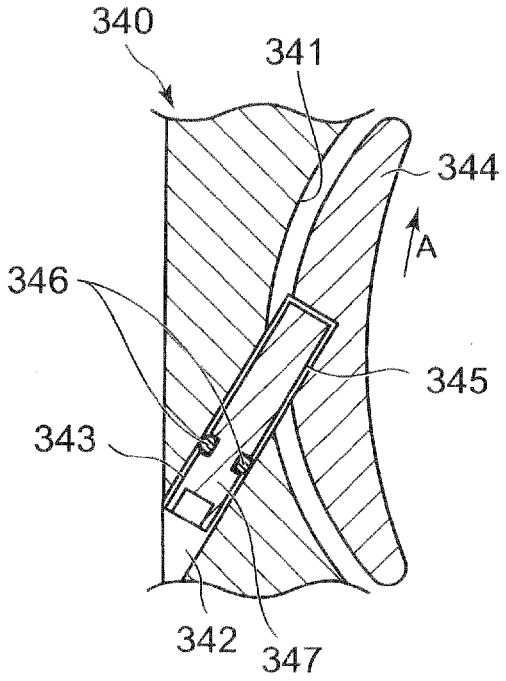
FIG. 20 is a cross-sectional view of another modification of the screwing-fixing device in the second embodiment.

For example, as shown in FIG. 20, screw hole 343 may be formed on case 340 so as to extend obliquely from the lower left to the upper right through case 340 and recess 341 into hole 345 on push head 344 such that screw 342 inserted into screw hole 343 can be driven in the hole. In this case, as screw 342 is driven in hole 343, push head 344 is rotated in an A-direction in FIG. 20 while being pushed out into case 340, thereby pushing the engagement element of the back cover.

Figure 21:
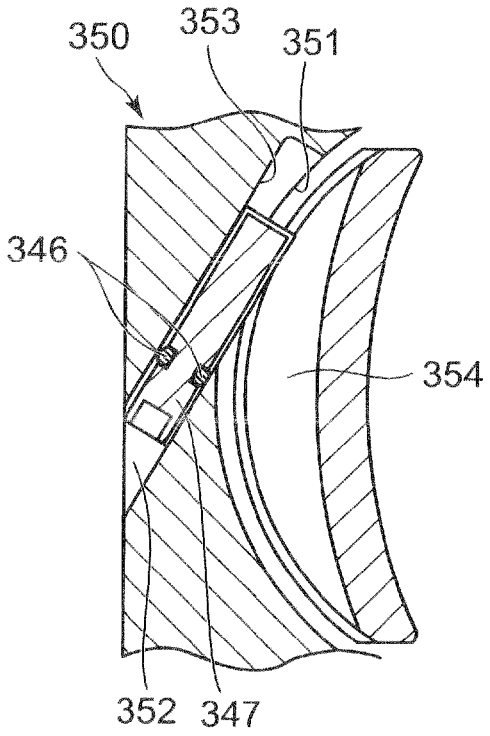
FIG. 21 is cross-sectional view of a further modification of the screwing-fixing device in the second embodiment.

For example, as shown in FIG. 21, case 350 may have screw hole 353 extending obliquely from the lower left to the upper right through case 350 into its recess 351 such that screw 352 inserted in hole 353 is driven, thereby pushing engagement element 354 of the back cover directly without using the push member.

As shown in FIGS. 20 and 21, when arrangement is such that screws 342 and 352 are inserted obliquely into cases 340 and 350, respectively, screws 342 and 352 appear quiet externally, which is preferable from a standpoint of design.

If obliquely extending screw holes through which screws 342 and 352 are inserted are formed on cases 340 and 350 so as to open, for example, on lugs of the outer housings to which the respective wristbands are connected, screws 342 and 352 inserted in the corresponding respective screw holes also appear quiet externally, which is preferable.

FIGS. 20 and 21 also show that, auxiliary members 347 with O-ring 346 inserted in screw holes 343, 353 are pushed against push head 344, engagement element 354 of the back covers by driving corresponding screws 342, 352, respectively. Preferably, each auxiliary member 347 is made of a non-conductive material. It is noted that arrangements in which screws 342 and 352 push the push member 344 and engagement element 354 are not limited to these examples of FIGS. 20 and 21, respectively.

For example, arrangements may be such that screws 342 and 352 directly push the push member 344 and engagement element 354, respectively, without using auxiliary members 347. In this case, preferably, the tips of screws 342 and 352 and the ends of push member 344 and engagement element 354 which screws 342 and 352, respectively, contact are coated with an insulating material.

While in the embodiment, screw 304 is illustrated as pushed against leg 323 of push member 306 through non-conductive member 321, screw 304 may directly contact leg 323 of push member 306 without using non-conductive member 321. In this case, preferably, the tip end of screw 304 or leg 323 of push member 306 is coated with an insulating material.

(Third Embodiment)

Figure 22:
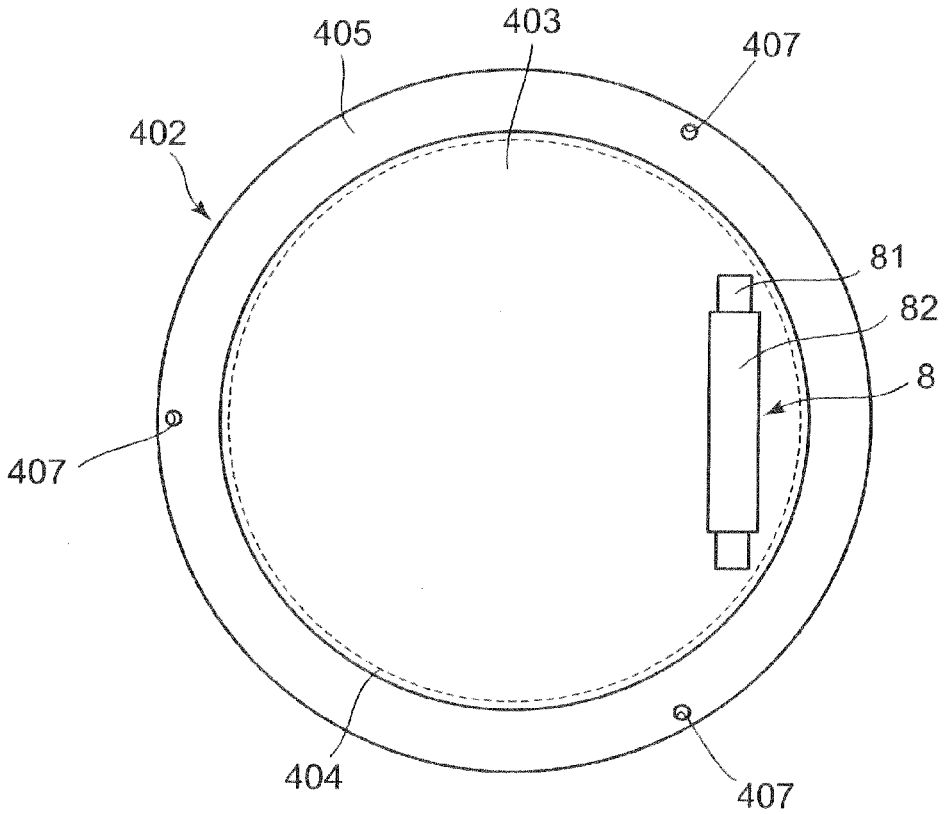
FIG. 22 is a plan view of a back cover of the timepiece according to a third embodiment.
Figure 23:
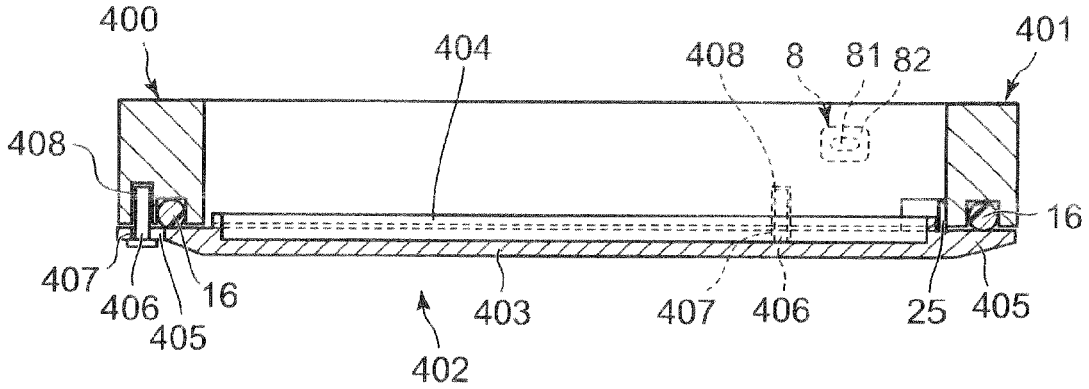
FIG. 23 is a cross-sectional view of an essential portion of the timepiece of the third embodiment in which the back cover is secured to the case.

Referring to FIGS. 22 and 23, a third embodiment of the radio controlled wristwatch according to the present invention will be described. The third embodiment is different from the first and second embodiments with reference to the structure in which the back cover is secured to the case. Thus, in this embodiment, the difference in the structure will be described especially.

In the third embodiment, the radio controlled wristwatch has outer housing 400 composed of case 401 and back cover 402 as in the first and second embodiments.

As shown in FIGS. 22 and 23, back cover 402 includes bottom 403, ring-like frame 404 upstanding from the periphery of bottom 403, flange 405 provided around bottom 403. Flange 405 has three holes 407 at 2, 6 and 10 o'clock positions thereof through which screws 406 are inserted from the back side of the wristwatch. Case 401 has screw holes 408 on the lower end face thereof at three different positions corresponding to the respective positions of boles 407 on flange 405.

As described above, in the present embodiment, three screwing-fixing devices are provided each including a respective one of holes 407 formed on back cover 402, and a corresponding one of screw holes 408 formed on case 401. These three screwing-fixing devices compose an outer-housing fixing structure to fix back cover 402 to case 401.

These three screwing sections are provided on one of two parts of outer housing 400 divided by the axis of antenna core 81 disposed within the housing and no other screwing sections are provided on the other part of the housing.

The other parts of the third embodiment similar to those of the first and second embodiments are identified by the same reference numerals and letters, and further description thereof will be omitted.

The fabricating method of this embodiment will be described. When back cover 402 is mated with case 401, three screw holes 408 on case 401 and corresponding holes 407 on back cover 403 are aligned. Then, three screws 406 are inserted from the back side of the wristwatch through these respective holes and then tightened through waterproof ring 16 to thereby secure back cover 402 to case 401 fixedly.

As described above, according to this embodiment, the outer-housing fixing structure which fixes case 401 to back cover 402 is provided only on one of two parts of outer housing 400 divided by the axis of bar shaped core 81 of antenna structure 8 disposed within the outer housing. Thus, although case 401 and back cover 402 are made of metal, no path for an eddy current which surrounds a flow of alternating magnetic flux is formed, thereby preventing occurrence of an eddy current loss and maintaining the reception sensitivity of antenna structure 8 high.

Back cover 402 is fixed to case 401 in a stabilized manner because they are fixed at a position on a part of outer housing 400 most distant from antenna structure 8 disposed within outer housing 400 and at other two different positions on the outer housing.

Since only the screws are used for fixing purposes, the structures of case 401 and back cover 402 are simple and they are excellent in productivity and easy in assembly.

While in the above respective embodiments the insulating sheet is illustrated as being provided on the inner peripheral surface of the case on its 12 o'clock side for insulating the case from the bottom cover, anything may be used as long as it can secure electrical insulation between the case and. the back, cover. For example, an insulating coating may be applied instead of pasting the insulating sheet.

The insulating sheet or coating may be pasted or applied to the outer peripheral surface of the frame of the back cover and not to the inner peripheral surface of the case. If there is no possibility that the case will contact the back cover, for example, if a gap enough to prevent contact between the case and the back cover is secured between these members, no insulating sheet is required to be provided.

For example, in the case of the third embodiment, the screws are inserted from below substantially perpendicular to the bottom of the wristwatch. Thus, when the back cover is fixed to the case, the ring-like frame of the back cover is not pushed against the inner peripheral surface of the case. Thus, in this case, no insulting sheet or coating is required to be applied.

While in the embodiment, the three outer-housing fixing structures are illustrated as used to fix the case and the back cover together, the number of these fixing structures is not limited to three. Four or more outer-housing fixing structures may be provided as long as they are all provided only on one of two parts of outer housing 400 divided by the axis of the antenna core disposed within outer housing 400.

While in the above respective embodiments the wristwatch is illustrated as having a circular shape, the shape of the wristwatch is not limited to this particular case, but may be, for example, square or elliptical.

While in the embodiments the radio controlled wristwatch is illustrated as an analog type with hands, the wristwatch is not limited to this particular case. It may be of a digital type with a liquid crystal panel or a combination of analog and digital types.

Other various modifications and changes may be made thereunto without departing from the broad spirit and scope of this invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

What is claimed is:

1. A radio controlled timepiece comprising:

a housing; and an antenna structure encased within the housing;

wherein the antenna structure includes a bar shaped core and a coil wound around the core, for receiving radio waves to set a current time;

wherein the housing comprises a short hollow cylindrical metal case and a metal back cover engaged with one end of the case to close the case, and a housing fixing structure for fixing the back cover to the case, the housing fixing structure being provided only on one of two parts of the housing divided by an axis of the bar shaped core;

wherein the housing fixing structure comprises three fixing substructures, one of the fixing substructures being provided on a portion of the housing most distant from the antenna structure, and the other two of the fixing substructures being provided at different positions on a periphery of the housing other than on the portion of the housing most distant from the antenna structure;

wherein the fixing substructure provided on the portion of the housing most distant from the antenna structure comprises a screwing-fixing device for fixing the case and the back cover together with a screw, and each of the other two fixing substructures comprises a matingly fixing device for matingly fixing the back cover to the frame;

wherein the screwing-fixing device comprises:

a screwing section for fixing therein, with a screw, the case and the back cover together;

a back cover-side engagement section provided on the back cover and having a surface inclined outwardly downward; and a case-side engagement section provided on the case at a position corresponding to a position of the back-cover side engagement section on the back cover and having an inclined surface corresponding to the inclined surface of the back cover-side engagement section;

wherein as the back cover and the case are screwed together in the screwing section, the back cover is pushed against the case while the inclined surface of the case-side engagement section is slid on the inclined surface of the back cover-side engagement section, thereby causing the back cover to be pushed out toward the part of the housing where no housing fixing structures are provided; and wherein each of the matingly fixing devices comprises a male mating unit having a mating projection provided on the back cover and a recess provided on the case at a position corresponding to a position of the male mating unit, the recess having a recess portion for finally receiving the mating projection provided on the back cover when the back cover is pushed against the case.

2. The radio controlled timepiece of claim 1, wherein one of the mating projection and the recess for receiving the mating projection is processed so as to secure electrical insulation between the mating projection and the recess.

3. The radio controlled timepiece of claim 1, wherein the other of the two parts of the housing divided by the axis of the bar shaped core and where no housing fixing structures are provided is processed so as to secure electrical insulation between the case and the back cover.

4. The radio controlled timepiece of claim 2, wherein the other of the two parts of the housing divided by the axis of the bar shaped core and where no housing fixing structures are provided is processed so as to secure electrical insulation between the case and the back cover.

5. The radio controlled timepiece of claim 2, wherein the processing comprises pasting or coating an insulating material on one of mutually adjacent surfaces of the case and the back cover.

6. The radio controlled timepiece of claim 3, wherein the processing comprises pasting or coating an insulating material on one of mutually adjacent surfaces of the case and the back cover.

7. The radio controlled timepiece of claim 4, wherein the processing comprises pasting or coating an insulating material on one of mutually adjacent surfaces of the case and the back cover.

* * * * *